US005148218A

United States Patent [19]

Nakane et al.

[11] Patent Number: 5,148,218

[45] Date of Patent: Sep. 15, 1992

[54] IMAGE FORMING APPARATUS WITH A HUMIDITY DETECTOR

[75] Inventors: Rintaro Nakane, Yokohama; Jiro Egawa, Yokosuka; Naruhito Yoshida; Toshihiro Kasai, both of Yokohama; Kunihiko Miura, Hiratsuka; Shinya Tomura, Yamato; Mitsuaki Kohyama, Tokyo, all of Japan

[73] Assignee: Kabushiki Kaisha Toshiba, Kawasaki, Japan

[21] Appl. No.: 720,683

[22] Filed: Jun. 25, 1991

[30] Foreign Application Priority Data

Jul. 3, 1990 [JP] Japan ..... 2-174507

[51] Int. Cl.[5] ..... G03G 21/00

[52] U.S. Cl. ..... 355/208; 73/336; 340/604; 355/206; 355/246

[58] Field of Search ..... 355/215, 30, 208, 214, 355/246, 203, 205, 206, 209; 73/336; 340/309.15, 309.3, 604

[56] References Cited

U.S. PATENT DOCUMENTS

| | | | |
|---|---|---|---|
| 4,367,036 | 1/1983 | Sakamaki et al. | 355/208 |
| 4,888,618 | 12/1989 | Ishikawa | 355/208 |
| 4,989,039 | 1/1991 | Hayashi et al. | 355/208 |
| 5,034,772 | 7/1991 | Suzuki | 355/208 |
| 5,041,865 | 8/1991 | Asano et al. | 355/30 |
| 5,091,743 | 2/1992 | Nagata et al. | 355/30 |

*Primary Examiner*—Joan H. Pendegrass
*Assistant Examiner*—Christopher Horgan
*Attorney, Agent, or Firm*—Foley & Lardner

[57] ABSTRACT

An image forming apparatus having a humidity detector which is detachably attached to the main apparatus body that accommodates an image forming member. The humidity detector detects a humidity in the vicinity of the image forming member, converts the detected humidity into a relative humidity and outputs it. Based on the value of the output relative humidity, image forming conditions, such as the amount of exposure, are set. The humidity detecting unit contains a time detecting unit for detecting the time for replacement.

3 Claims, 7 Drawing Sheets

IMAGE FORMING APPARATUS WITH A HUMIDITY DETECTOR

BACKGROUND OF THE INVENTION

1. Field of the Invention

The present invention relates to an image forming apparatus with a detachable humidity detector unit which requires no adjustment after its installation in the apparatus.

2. Description of the Related Art

Conventionally, a humidity detector and a temperature detector are provided to detect the accurate relative humidity in the vicinity of a photosensitive drum in a color laser printer. A temperature-oriented change in the detection output of the humidity detector is compensated for with the temperature detected by the temperature detector. The humidity and temperature detectors are constituted integrally and are coupled to a temperature compensator.

The humidity detector will deteriorate even when not supplied with electricity. Its service life is about 10,000 hours (1 to 1.5 years). This service life is shorter than that of the image forming apparatus, and the humidity detector often needs replacing. Since the temperature detector is a thermistor or the like, its service life is as long as that of the image forming apparatus. The humidity detector and temperature detector are integral. Thus when the life of the humidity detector expires and needs replacing, the temperature detector, which requires no replacing yet must also be replaced at the same time. This is very uneconomical.

The temperature detector and the humidity detector cannot meet the exact specifications, due to changes of the conditions, though slight, in which they have been made. Consequently, the temperature detector fails to output a voltage which accurately corresponds to the ambient temperature, and the humidity detector fails to output a voltage which accurately corresponds to the ambient humidity. Inevitably, it is necessary to adjust these detectors, so that they output voltages exactly corresponding to the temperature and humidity.

SUMMARY OF THE INVENTION

It is, therefore, an image forming apparatus which facilitates replacement of a humidity detector, designed together with a temperature detector to form a unit, without any adjustment, thus reducing the amount of work required for maintenance of the humidity detector at the time of its replacement.

To achieve this object, an image forming apparatus of the present invention comprises:

image forming means;

humidity detecting means, attached detachable to a main body accommodating the image forming means, for detecting the humidity in the vicinity of the image forming means, and converting the detected humidity into a value of a relative humidity as an output; and condition setting means for setting image forming conditions in accordance with the relative humidity output from the humidity detecting means.

With the above structure, the image forming apparatus of the present invention can permit the humidity detector to be replaced easily without requiring any adjustment and can reduce the required maintenance at the time of replacement.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of the image forming apparatus according to the present invention will now be described referring to the accompanying drawings.

Figure 1:
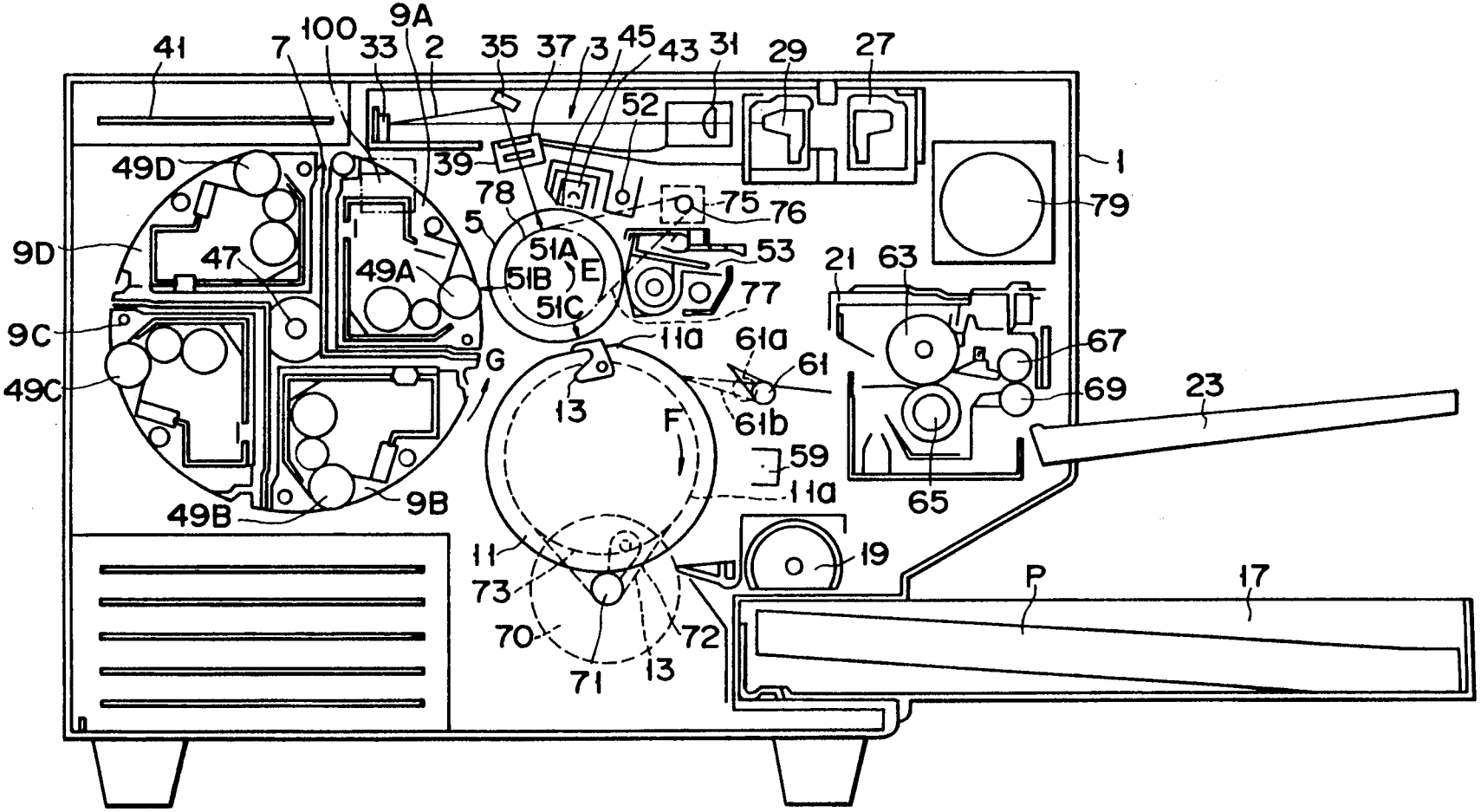
FIG. 1 is a schematic diagram illustrating the internal structure of a laser printer as an image forming apparatus according to one embodiment of the present invention.

FIG. 1 illustrates a color laser printer as an image forming apparatus of the present invention. Using a laser beam 2, this laser printer sequentially irradiates image information, supplied from an external component for every color component, via an exposing optical system 3, such as a mirror or a lens, on a photosensitive drum 5 which has been previously electrified, thereby forming an electrostatic latent image. The photosensitive drum 5 has its surface coated with an organic photoreceptor, and is rotated by a pulse motor 75 in the direction of the arrow E. The toner for the first color from a developing unit 9A adhere to the photosensitive drum 5 to transform the electrostatic latent image formed by the laser beam 2 into a toner image.

A transfer drum 11, as a rotor, is located under the photosensitive drum 5, to be rotated by a pulse motor 70 in the direction of the arrow F. The transfer drum 11 has a flat portion 11*a*, where grippers 13 are provided as a supporter. These grippers 13 hold transfer sheet P (medium on which an image is to be formed) which is retained in a paper-feeding cassette 17. Transfer sheet P is attached to the outer surface of transfer drum 11. The photosensitive drum 5 and the transfer drum 11 rotate, facing each other while maintaining their contact at a position 51C, except for the flat portion 11*a*, so that the toner image for the first color formed on the photosensitive drum 5 is transferred onto the transfer sheet P. When the toner image for the first color has been transferred onto the transfer sheet P, the transfer drum 11 is rotated to face the flat portion 11*a* at the position 51C of the photosensitive drum 5, so that both drums are separated from each other and stop rotating. As a result, the initial position of the transfer sheet P on the transfer drum 11 faces the photosensitive drum 5 at the position 51C. Since the photosensitive drum 5 can be also rotated in the direction E, if the drum 5 is stopped at the position 51C as its start position, the image transfer can be started again. In the same manner as described above, toner images for the second, third and fourth colors are transferred sequentially onto the transfer sheet P. After the transfer is completed, the transfer sheet P is separated from the transfer drum 11, and sent to a fixing device 21 where the image is fixed. The sheet P is then discharged onto a collecting tray 23.

The exposure optical system 3, provided on the upper portion of a recording apparatus 1, comprises a fast motor 27, a polygon rotational mirror 29, $f\theta$ lens 31, reflectors 33 and 35, non-spherical lens 37 and a protection glass 39. The laser beam 2 emanated from a semiconductor laser oscillator (not shown), according to the desired image information, is shaped by a beam shaping optical system (not shown), comprising a cylindrical lens, for example, and is then supplied to this exposure optical system 3. The laser beam 2 is also deflected by the rotational mirror 29 which is driven by the fast motor 27 using air bearings, and controlled by a drive controller 41 located adjacent to the exposure optical system 3 at the upper portion of the recording apparatus 1. The deflected beam 2 passes through the $f\theta$ lens 31, and is reflected by the reflectors 33 and 35. The reflected beam, after passing through the non-spherical lens 37 and protection glass 39, reaches and forms a spot image at an exposure position 51A on the photosensitive drum 5 with the desired resolution, thereby exposing the drum 5 while scanning it.

An electrifying charge 43 for charging the drum surface, a developer support 7 with developing units of different colors, a transfer drum 11 which rotates with a transfer sheet P attached on the drum surface, a cleaner 53 and a deelectrifying lamp 52 are disposed along the rotational direction E around the photosensitive drum 5. The photosensitive drum 5 is driven by the pulse motor 75 (to be described later) and its drum surface is electrified by the charger 43 having a grid electrode 45 and located facing the drum surface. A spot image of the laser beam 2 is formed through the protection glass 39 at the exposure position 51A on the charged drum surface of the photosensitive drum 5, and electrification is eliminated according to the laser beam 2, thus providing an electrostatic latent image thereon. When the photosensitive drum 5 carrying the latent image rotates at the circumferential velocity $V_O$ in the direction E to a developing position 51B, it contacts the developing unit 9A of the developer support 7, and yellow toners are supplied to the photosensitive drum 5 from a developer sleeve 49A.

The cylindrical developer support 7 retaining this developing unit 9A further accommodates a developing unit 9B with a developer sleeve 49B holding magenta toner, a developing unit 9C with a developer sleeve 49C holding cyan toner, and a developing unit 9D with a developer sleeve 49D holding black toner, all adjacent to one another. The developer support 7 is rotated in the direction G around a center shaft 47 by a mechanism driver 89 (FIG. 2), which will be described later, so that the developing units 9A–9D are sequentially rotated to the developing position 51B of the photosensitive drum 5 every time the transfer of each color on the transfer sheet P stuck on the transfer drum 11 is completed. For instance, the toner image formed by the yellow toners for the first color is transferred on the transfer sheet P on the transfer drum 11 at the transfer position 51C of the photosensitive drum 5, but the developer support 7 rotates in the direction of the arrow G during a period of time from the end of the image transfer to the beginning of the image transfer for he second color, thus moving the developing unit 9B for the second color, magenta, to the developing position 51B of the photosensitive drum 5.

The photosensitive drum 5, on which tones of one color in any of the developing units 9A to 9D are stuck, forming the associated toner image, further rotates so that the toner image is transferred on the transfer sheet P on the transfer drum 11 at the transfer position 51C. After the image transfer at the transfer position 51C, the photosensitive drum 5 further rotates in the direction of the arrow E, so that the residual toners remaining on the surface of the drum 5 are removed by the cleaner 53 located opposite the drum 5. The potential remaining on the surface of the photosensitive drum 5 is then removed by the deelectrifying lamp 52.

The rotational force of the pulse motor 75 is transmitted via a pulley 76, coupled to the drive shaft of the pulse motor 75, and a timing belt 77 to a pulley 78 coupled to the rotary shaft of the photosensitive drum 5, and the force is thus applied to the drum 5.

The rotational force of the pulse motor 70 is transmitted via a pulley 71, coupled to the drive shaft of the pulse motor 70, and a timing belt 72 to a pulley 73 which is coupled to the rotary shaft of the transfer drum 11, and the force is thus applied to the drum 11.

Around the transfer drum 11 are provided a feed roller 19, a corona charger 59 for deelectrification of a transfer sheet and a movable guide plate 61 beside the photosensitive drum 5.

When transfer sheets P in the paper-feeding cassette 17 are fed out one by one by the rotation of the feed roller 19, the grippers 13 provided on the flat portion 11*a* of the transfer drum 11 hold the leading edge of the fed sheet P. Then, a bias voltage (FIG. 2) from a high-voltage supply 90 is applied to the transfer drum 11, permitting the transfer sheet P to stick on the drum 11. The transfer drum 11 with the transfer sheet P thereon rotates at a predetermined velocity in the direction of the arrow F to the transfer position 51C of 15 the photosensitive drum 5. When the flat portion 11*a* of the transfer drum 11 reaches the transfer position 51C, the pulse motor 70 stops rotating, moving into a holding state. When scanning and exposure of the photosensitive drum 5 with the laser beam 2 starts, the transfer drum 11 is rotated at a timing so that the leading edge of the toner image on the drum 5 coincides with the leading edge of the transfer sheet P at the transfer position 51C. At this time, the toner image on the photosensitive drum 5 is transferred on the transfer sheet P while the transfer drum 11 and the photosensitive drum 5 are rotating at a synchronized speed.

When the trailing edge of the transfer sheet P passes the transfer position 51C of the photosensitive drum 5, completing the image transfer, the transfer drum 11 rotates at a predetermined velocity to the transfer position 51C of the drum 5. When the flat portion 11*a* of the transfer drum 11 reaches this transfer position 51C, the pulse motor 70 stops rotating and goes into a holding state. When scanning and exposure of the photosensitive drum 5 for the next image data with the laser beam 2 starts, the transfer drum 11 is rotated at such a timing that the leading edge of the toner image on the drum 5 coincides with the leading edge of the transfer sheet P at the transfer position 51C. Thereafter, the operation will be performed in the same manner.

This operational sequence is repeated until transfer of a full-color image, for example, four colors superimposed one on another, is completed.

When the transfer of the toner images for all the colors is completed, the movable guide plate 61, having one end rotatably supported and the other end provided movable closer or away from the surface of the transfer drum 11, is moved in the direction 61*b* from a position (61*a*) apart, for example, by several centimeters from the surface of the transfer drum 11, thereby coming into contact with the drum 11. As a result, the transfer sheet P stuck on the transfer drum 11 is separated therefrom and guided to a fixing unit 21 by the movable guide plate 61; the fixing unit 21 is located in the vicinity of the guide plate 61. The transfer sheet P is conveyed between a heat roller 63 and pressure roller 65 in the fixing unit 21, so that the toner image is thermally fixed on the transfer sheet P by rollers 63 and 65. The transfer sheet P is then fed out and discharged on the collecting tray 23 by discharge rollers 67 and 69.

A cooling fan 79 cools the exhaust heat generated by the heat roller 63 of the fixing unit 21 or the like to thereby prevent the temperature in the recording apparatus 1 from increasing.

Figure 3:
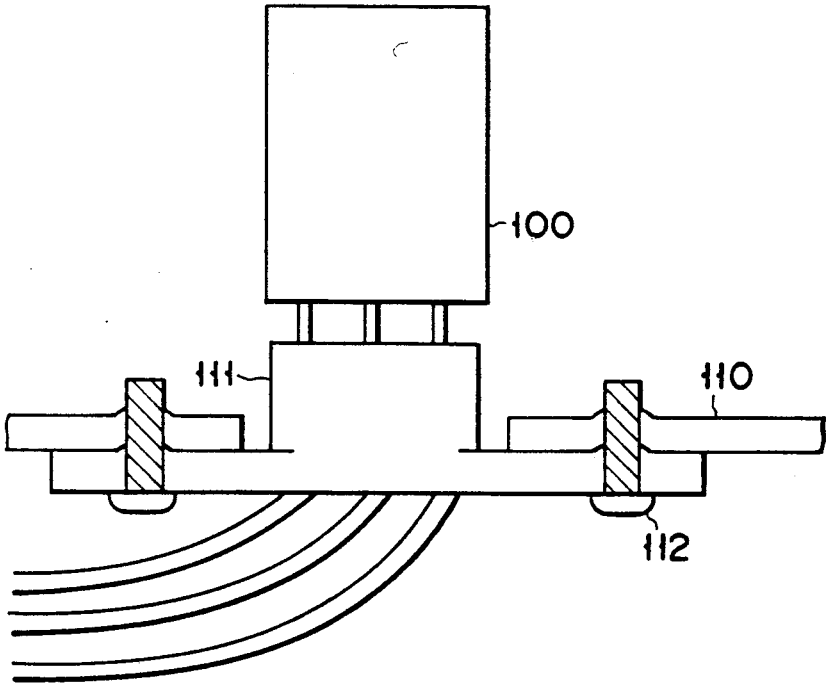
FIG. 3 is a diagram illustrating how a humidity detector of the image forming apparatus according to the present invention is detachable attached to the apparatus frame.
Figure 4:
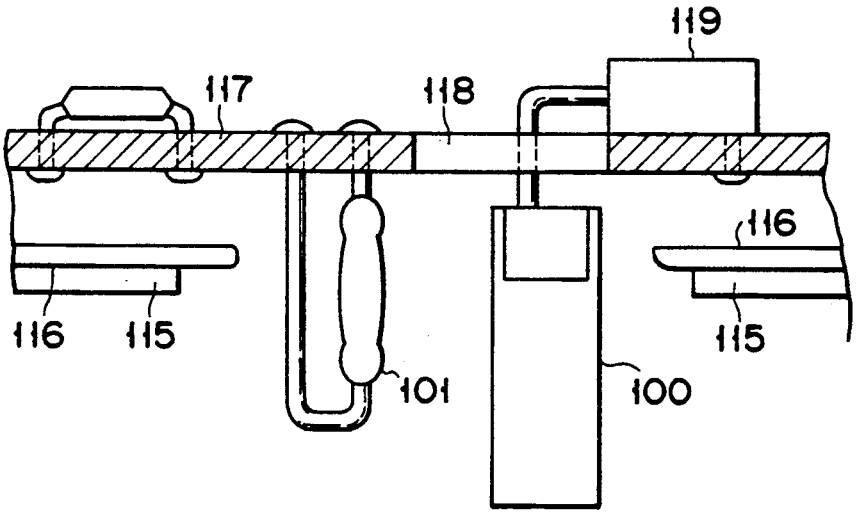
FIG. 4 is a diagram illustrating how the humidity detector of the image forming apparatus according to the present invention is detachably mounted on the circuit board disposed in the apparatus.

In the vicinity of the photosensitive drum 5 are provided a humidity detector 100 and a temperature detector 101. The humidity detector 100 is attached to a connector 111, which is secured by screws 112 to the frame 110 on the front side of the apparatus in such a way as to be disposed inside the apparatus, as shown in FIG. 3. This design permits easy replacement of the humidity detector 100 when the front panel is opened. As another embodiment, the humidity detector 100 may be coupled to a connector 119 secured to a circuit mounting board 117 on the outer cover side, as shown in FIG. 4. In this case, the humidity detector 100 is attached in the vicinity of the photosensitive drum 5 and developing units 9A–9D, located in the apparatus, via a sensor mounting hole 118 formed in the mounting board 117 and the gap between a metal plate 115 for protection for the board 117 and Mylar board 116. With this structure, when the front panel is opened, replacement of the humidity detector 100 can be easily done.

The attaching position of the humidity detector 100 is not limited to the above locations, and the detector 100 may be attached wherever desirable, as long as it can measure or detect a humidity matching with the humidity around the photosensitive drum 5.

Figure 2:
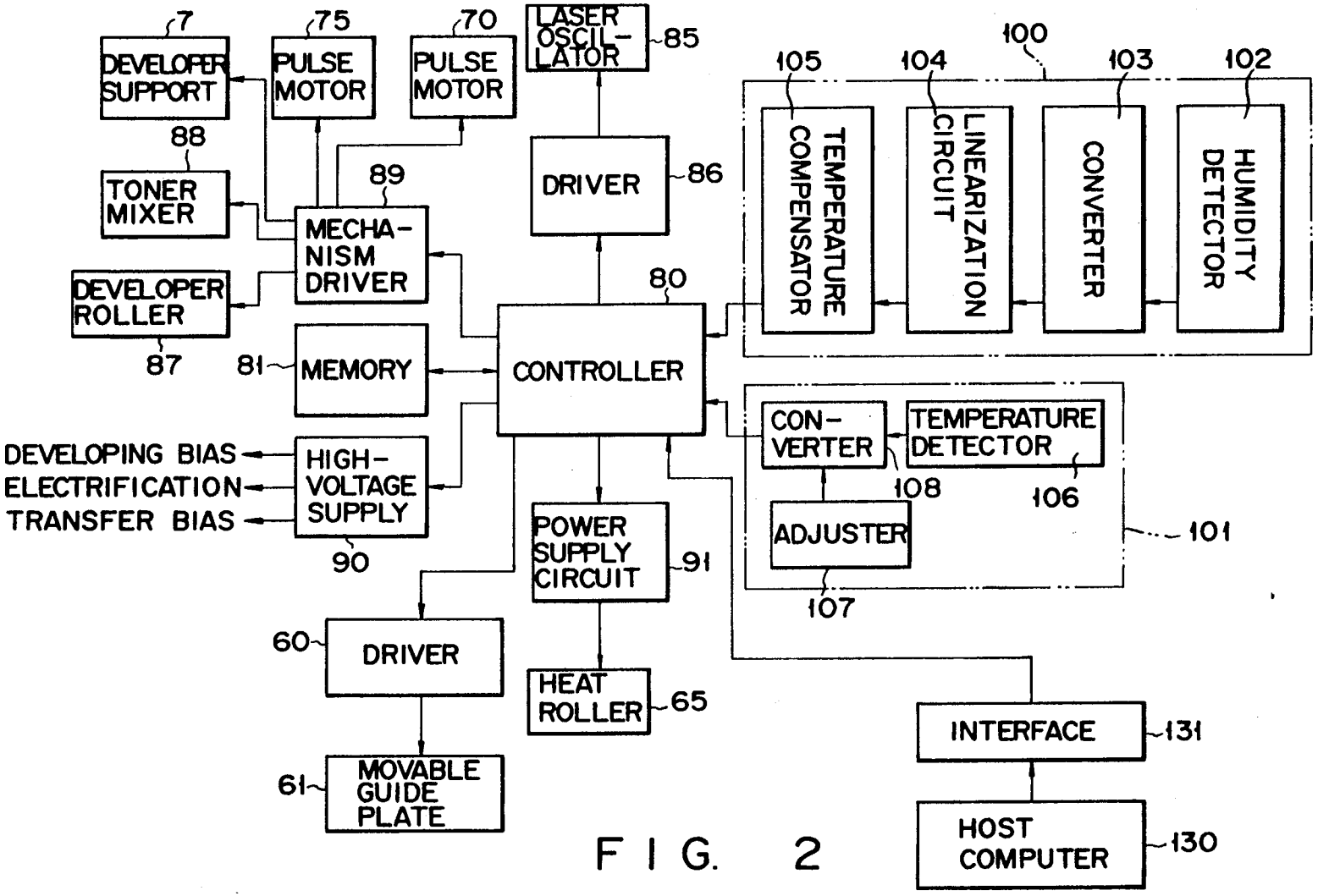
FIG. 2 is a circuit structure illustrating the essential parts of the electronic circuit of the laser printer shown in FIG. 1.

FIG. 2 is a block diagram illustrating the essential portions of an electric circuit of the color laser printer shown in FIG. 1. A controller 80 generally controls the apparatus. To this controller 80 is connected a memory 81 which stores image data for one page per color supplied from an external unit (not shown) or has a control program stored therein. To the controller 80 is also connected a driver 86 which drives a semiconductor laser oscillator 85 in accordance with image data from the memory 81 and controls the amount of exposure provided by the oscillator 85 in response to a control signal from the controller 80.

The aforementioned high-voltage supply 90, which applies a developing bias to the developing units 9A–9D and a transfer bias to the transfer drum 11, is further connected to the controller 80. The controller 80 is also connected with the aforementioned mechanism driver 89, the humidity detector 100 and the temperature detector 101. The mechanism driver 89 drives a developer roller 87 and a toner mixer 88 in the developing units 9A–9D, drives the developer support 7, drives the pulse motor 70 to rotate the transfer drum 11, and drives the pulse motor 75 to rotate the photosensitive drum 5. The humidity detector 100 detects a relative humidity in the vicinity of the photosensitive drum 5, while the temperature detector 101 detects a temperature in the vicinity of the drum 5. The temperature detector 101 detects a temperature to be used in control associated with the temperature characteristic, and sends the detection output to the controller 80.

The humidity detector 100 outputs a voltage value corresponding to the relative humidity in the vicinity of the photosensitive drum 5 as the detection result while performing temperature compensation. The humidity detector 100 includes a humidity detector or sensor 102 whose resistance varies with a change in humidity in the vicinity of the photosensitive drum 5, a converter 103 for converting the resistance from the sensor 102 into a voltage, a linearization circuit 104 for compressing the voltage from the converter 103, and a temperature compensator 105 for compensating for the voltage from the circuit 104 in accordance with the current temperature.

Figure 5:
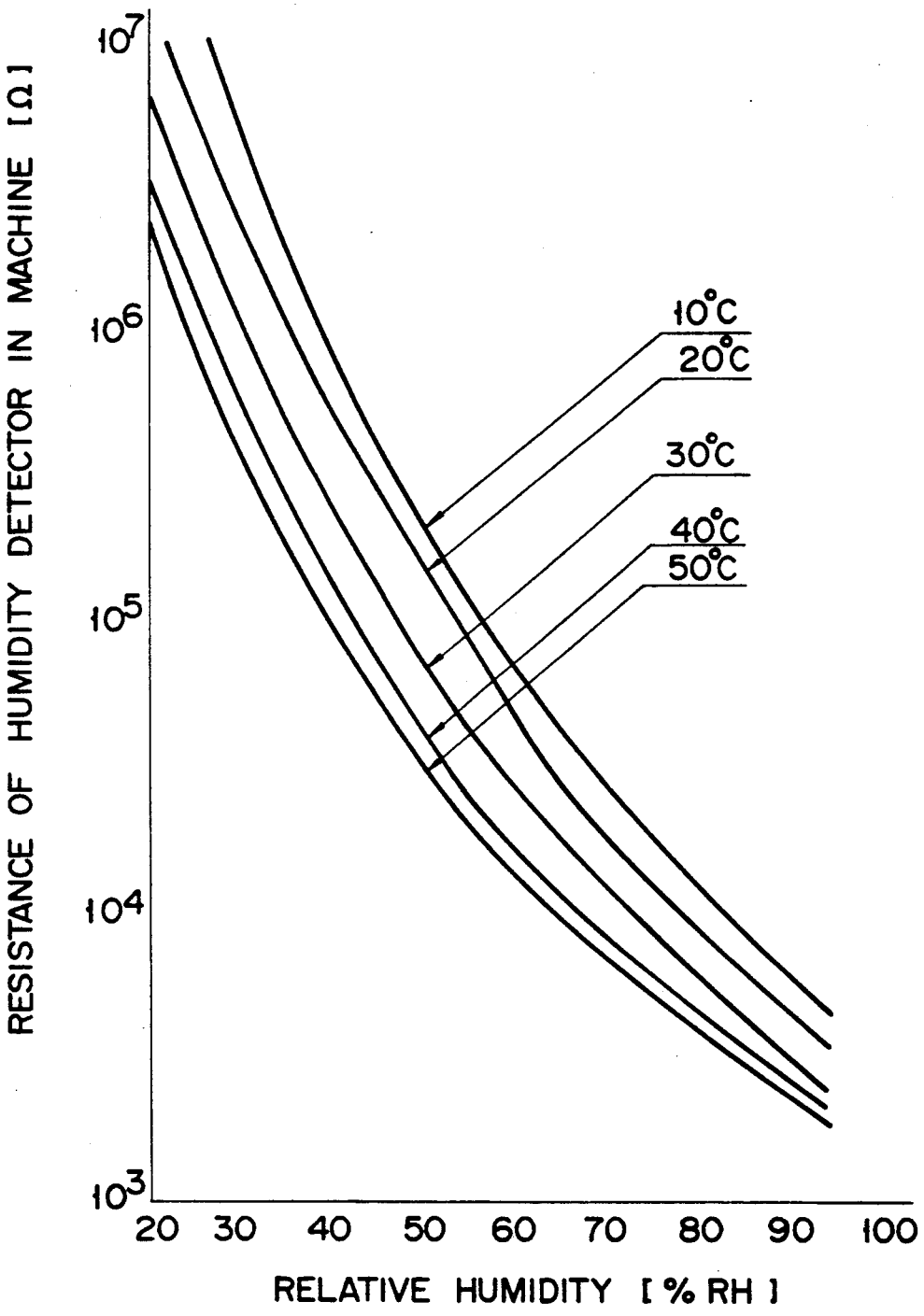
FIG. 5 is a graph representing the relation between a change in the resistance of a humidity sensor indicating relative humidity to a change in temperature in the apparatus.

FIG. 5 shows the characteristic of a change in resistance with respect to the relative humidity in the apparatus caused by the humidity sensor 102. The characteristic of the resistance changes with a change in temperature. The converter 103 and the linearization circuit 104 each comprise a logarithm compressing circuit, constituted by a differential amplifier and two diodes, for example, so that the output of the humidity sensor 102 or the current signal which varies exponentially is converted into a compressed voltage signal by the logarithm compressing circuit. The temperature compensator 105, which comprises a diode for temperature compensation, is adjusted by selecting the rated value of a corresponding diode at the time the humidity detector 100 is shipped. With this design, a variation in the humidity detectors caused by a variation in the circuit constants of the humidity sensor 102 and the individual circuits can be adjusted by changing the rated value of the temperature-compensating diode, or the variation in circuit constants is adjusted by changing the inclination of the ratio of the output voltage to the relative humidity in the apparatus from the humidity detector 100.

Figure 6:
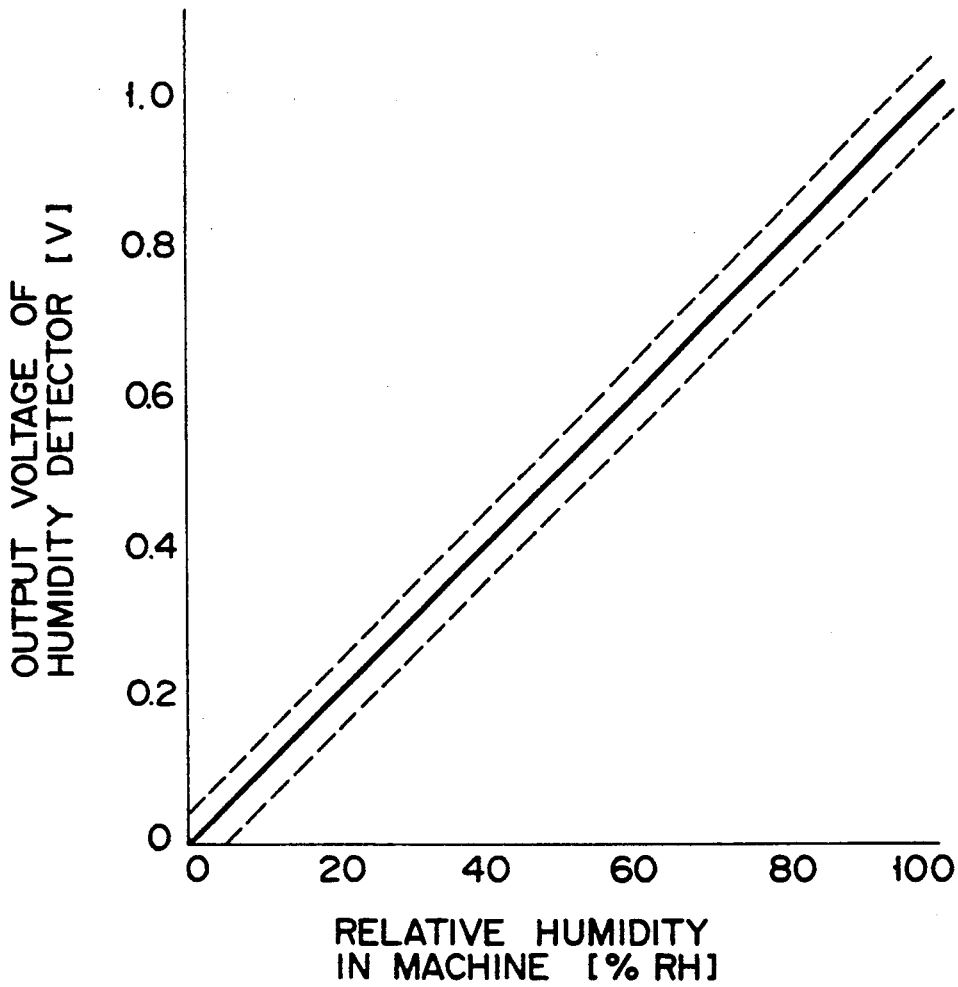
FIG. 6 is a graph expressing the relation between a change in the output voltage of the humidity detector to the relative humidity.

In this case, the output voltage to the relative humidity in the apparatus from the humidity detector 100 is so adjusted (normalized) as to be output within the broken lines or an error of ±5% with respect to the real line as shown in FIG. 6.

The temperature detector 101 outputs a voltage corresponding to the temperature in the vicinity of the photosensitive drum 5 as its output. This temperature detector 101 comprises a temperature sensor 106 constituted by a thermistor or the like, whose resistance varies with a change in temperature in the vicinity of the photosensitive drum 5, a converter 108 for converting the resistance from the sensor 106 into a voltage, and an adjuster 107 for adjusting the voltage value from the converter 108 by altering the resistance of a variable resistor (not shown) by means of a volume control.

With this design, by adjusting the volume of the variable resistor at the time of shipment, the output voltage of the temperature detector 101 with respect to the relative temperature can therefore be changed to have a predetermined value with respect to the temperature measured by a measuring unit (not shown).

The operation of the laser printer with the abovedescribed structure will now be described. With power on, the controller 80 determines the humidity in accordance with the voltage which is supplied from the humidity detector 100. Then, in accordance with the determined humidity, the controller 80 determines the amount of exposure from the semiconductor laser oscillator 85, the rotational speeds of the developer roller 87 and the toner mixer 88 in each of the developer units 9A to 9D, a developing bias to the developer units 9A to 9D, a voltage to be applied to the electrifying charger 43, a transfer bias to the transfer drum 11, and the temperature of the heat roller 65. The controller 80 performs such general control based on the determined values (FIG. 2), that printing can proceed under the optimal image forming conditions.

Under such conditions, the laser printer receives image information and instructions on the transfer density, etc. from external devices, such as a host computer 130 and an interface 131. The controller 80 drives the mechanism driver 89, so that the developer sleeve 49A which carries yellow toners retained in the developer 9A contacts the photosensitive drum 5, and that the transfer drum 11 is rotated at a predetermined speed. When the flat portion 11*a* comes in the vicinity of a position where the transfer sheet P is fed out from the paper-feeding cassette 17, the transfer drum 11 is stopped, i.e., the controller 80 stops the mechanism driver 89 from driving the transfer drum 11. At this time, the gripper pair 13 provided at the respective sides of the flat portion 11*a* of the transfer drum 11 are kept open. Accordingly, the leading end of the transfer sheet P fed out from the paper-feeding cassette 17 by the feeding roller 19 comes in contact with the grippers 13. The grippers 13 then close and hold the leading edge of the transfer sheet P on the transfer drum 11. As a bias voltage is applied to the transfer, drum 11 at this time, the transfer sheet P sticks to the surface of the drum 11.

The controller 80 then drives the mechanism driver 89 to rotate the transfer drum 11 and the photosensitive drum 5 at a predetermined velocity.

When the flat portion 11*a* of the transfer drum 11 faces the photosensitive drum 5 at the transfer position 51C, the controller 80 stops the rotation of the transfer drum 11. The transfer drum 11 and the photosensitive drum 5 are set apart from each other at this time, and the drum 5 can freely rotate accordingly.

Further, the controller 80 separates image information, which has been sent from the external devices and stored in the memory 81, by the color components, and store the separated image information in the memory 81. The controller 80 sequentially reads out image information for the first color and supplies it to the driver 86. Upon reception of the information, the driver 86 forces the semiconductor laser oscillator 85 to generate the laser beam 2 according to the image information. The laser beam 2, emanated from the semiconductor laser oscillator 85, is shaped by the shaping optical system, and is deflected by the polygon rotational mirror 29. The deflected laser beam 2 is reflected via the f$\theta$ lens 31 by the reflectors 3 and 35. The laser beam 2 forms a spot image on the position 51A on the photosensitive drum 5 with the desired resolution via the spherical lens 37 and the protection glass 39, to conduct image scanning and exposure The laser beam 2 irradiated through the protection glass 39 de-electrifies the photosensitive drum 5 which has been electrified by the electrifying charger 43 in advance. An electrostatic latent image according to the original image of a document therefore is formed on the photosensitive drum 5. The photosensitive drum 5 carrying the electrostatic latent image thereon, rotates at a predetermined speed, and contacts the developer sleeve 49A carrying the yellow toners retained in the developing unit 9A, at the developer position 51B. By this contact, the yellow toners are adhered onto the electrostatic latent image on the photosensitive drum 5 to form a toner image. Since the photosensitive drum 5 and the transfer drum 11 rotate while maintaining their contact at the transfer position 51C, the toner image on the drum 5 is transferred to the transfer sheet P on the drum 11.

After the photosensitive drum 5 has transferred the toner image to the transfer sheet P on the transfer drum 11, the cleaner 53 removes the toner remaining on the surface of the drum 5, and the de-electrifying lamp 52 de-electrifies the surface of the drum 5. The transfer drum 11 is so moved that the flat portion 11*a* will face the photosensitive drum 5 at the transfer position 51C.

A toner image for the second color, magenta, is transferred in the same manner as described above, which starts with the controller 80 sequentially reading image information for the second color from the memory 81.

The operation described above is repeated while the transfer bias voltage is altered for the individual colors. A full-colored image will be acquired as a superposition transfer with toners for four colors, yellow from the developer unit 9A to black from the developer unit 9D is completed. The controller 80 outputs a drive signal to move the movable guide plate 61 from the position 61*a*, about two to three centimeters away from the transfer drum 11, to the position 61*b*. The movable guide plate 61 therefore contacts the transfer drum 11, and stops the drum 11 from rotating when the grippers 13 come opposite to the position from which the sheet P is supplied.

Accordingly, the transfer sheet P, on which the full-colored toner image has been transferred, is separated from the transfer drum 11 by the movable guide plate 61, and is sent between the heat roller 63 and pressure roller 65 of the fixing unit 21 which fixes the toner image on the sheet P. The transfer sheet P is then conveyed by the discharge rollers 67 and 69, and is discharged on the collecting tray 23.

With a label indicating the date of the attachment being attached onto the humidity detector 100 to check the life of the detector 100, the output to the reference measuring unit is off the range of $\pm 5\%$ at the time of maintenance after one year or later, i.e., if a voltage value to a predetermined humidity lies outside the broken lines shown in FIG. 6, the humidity detector 100 should be replaced with a new one.

As described above, according to the image forming apparatus of the present invention, the humidity detector is designed as a unit incorporating the humidity sensor and the temperature compensator, and requires no adjustment after installation, i.e., no adjustment is necessary at the time the humidity detector needs replacing according to the maintenance check. This design feature can facilitate the replacement work for the humidity detector. The best conditions for forming an image can be set by the time the first printing starts after the power is turned on.

According to the above-described embodiment, the life of the humidity detector 100 is checked referring to the attachment date indicated on the label on the humidity of detector 100. The checking may be done by another method.

Figure 7:
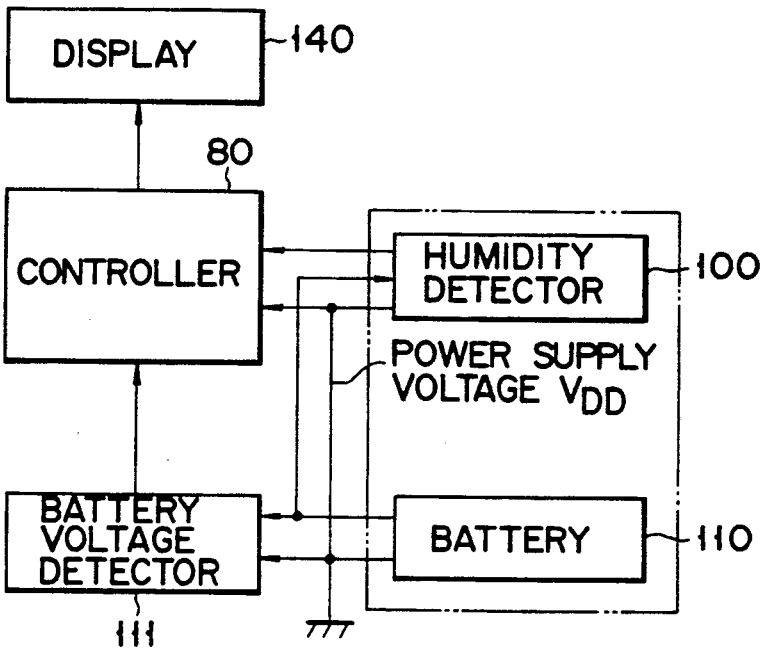
FIG. 7 is a block diagram illustrating the structure of the circuit which uses a battery to control the life of the humidity detector.

For example, the battery 110' having substantially the same life as the humidity detector 100 may be attached integral to the detector 100, as shown in FIG. 7. A battery voltage detector 111' detects a voltage drop of the battery 110 in accordance with the level change in impedance, and sends a detection signal to the controller 80. The controller 80 detects the time for replacement of the humidity detector 100 and the battery 110 by the detect signal from the battery voltage detector 111', and displays the detection result on a display 140. In accordance with this detection signal (presence or absence of the impedance) from the battery voltage detector 111', the controller 80 also determines if the humidity detector 100 and the battery 110' are attached or not yet attached.

The life of the humidity detector 100 may be maintained by checking using a timer if a predetermined period of time has passed, or using a counter if a predetermined number has been counted. The timer or the counter is to be initialized when the attachment of a new humidity detector 100 is detected by checking whether the attachment connecter of the humidity detector 100 has been partially short-circuited.

Figure 8:
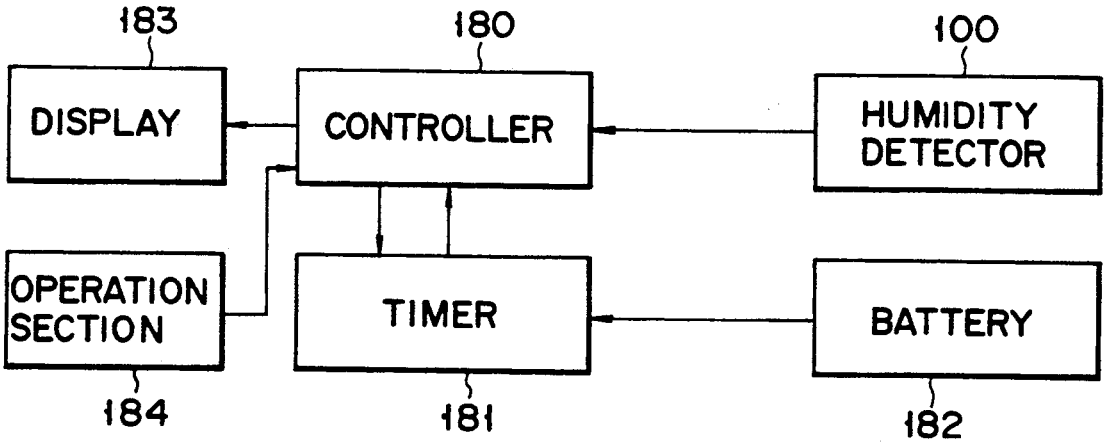
FIG. 8 is a block diagram illustrating an embodiment which detects by means of a timer the time for replacing the humidity detector.

FIG. 8 illustrates a block diagram of another embodiment which detects the time for replacing the humidity detector 100 by a timer.

The humidity detector 100 is connected via a controller 180 to a timer 181. This timer 181, which is designed to measure a long period of time, longer than ten months or one year, is driven by a battery 182. The battery 182, even when not charged, lasts longer than the humidity detector 100. When the time for replacement of the humidity detector 100, set in the timer 181, has elapsed, a signal informing the operator of arrival of the replacing time is indicated in some form on a display 183 via the controller 180. Accordingly, the operator should replace the humidity detector 100 with a new one, and operate an operation section 184 to reset the timer 181 via the controller 180.

Figure 9:
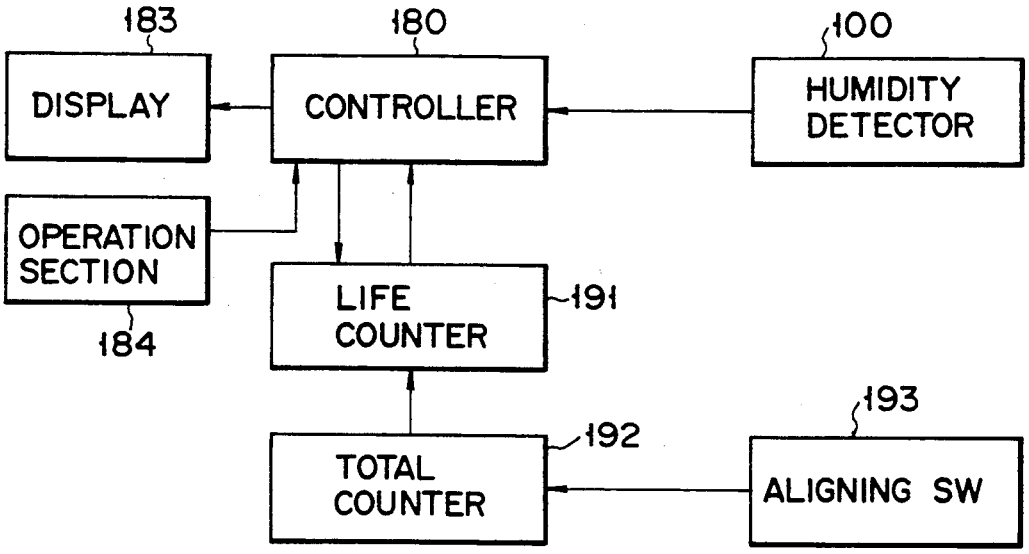
FIG. 9 is a block diagram illustrating another embodiment, which detects the time for replacing the humidity detector by means of a counter.
Figure 10:
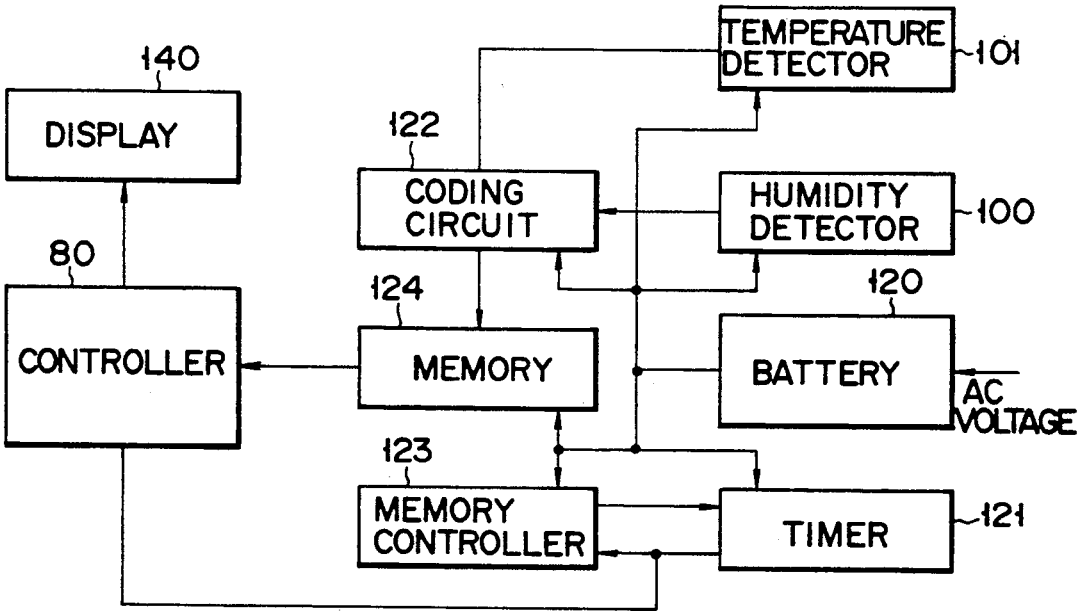
FIG. 10 is a block diagram illustrating the structure of a circuit which detects the history of the humidity in the apparatus.

FIG. 9 is a block diagram illustrating another embodiment which detects the time for replacement of the humidity detector 100 using a counter. The humidity detector 100 is connected via the controller 180 to a life counter 191. When the life counter 191 counts the number indicating the time for replacement, such information is displayed on the display 183 under the control of the controller 180. This count number is a number acquired by multiplying an estimated amount of sheets to be used per month by the total number of months as the life of the humidity detector, and what should be counted up by the counter 191. The life counter 191 is connected to an aligning switch 193 via a total counter 192.

When the transfer sheet starts being supplied and printing is ready, the aligning switch 193 is rendered on to allow the count-up operation of the total counter 192 that counts the total number of prints. In synchronism with the total counter 192, the life counter 191 starts counting up to the count number for the replacement time.

The operator, when confirming that the replacement time is indicated on the display 183, will replace the humidity detector 100 to a new one, and operate the operation section 184 to reset the life counter 191 via the controller 180.

In this manner, the operator will know the life of the humidity detector 100 or the timing for replacement thereof can be informed without using any measuring unit.

The previous conditions of humidity and temperature in the apparatus are stored in advance, and the absorbing property of a powder material (developer), the transfer sheet, etc. are determined from those conditions. In accordance with a discriminating result, it is possible to perform fine adjustment of the amount of exposure by the semiconductor laser oscillator 85, rotational speeds of the developer roller 87 and the toner mixer 88 in each of the developer units 9A to 9D, the developing bias to the developer units 9A to 9D, the voltage to be applied to the electrifying charger 43, the transfer bias to the transfer drum 11 and the temperature of the heat roller 65, al of which are determined by the above-described humidity and temperature. Therefore, printing can be executed under the optimal image forming conditions.

As shown in FIG. 8, for example, a voltage value acquired by the humidity detector 100 with respect to the relative humidity and a voltage value acquired by the temperature detector 101 with respect to a temperature are coded (quantized) in a coding circuit 122, and are sent to a memory 124. In response to a time out signal generated from the timer 121 for every 30 minutes, a memory controller 123 stores a voltage value corresponding to the coded signal from the coding circuit 122 into the memory 124; for example, the voltage values for every 30 minutes in the last eight hours are stored into the memory 124. Accordingly, the controller 80 displays the contents of the memory 124 on the display 140 or determines the water absorbing property of a powder material (developer), the transfer sheet or the like from the humidity status (history) for every 30 minutes for the last eight hours. In accordance with the discrimination result, it is possible to perform fine adjustment of the amount of exposure by the semiconductor laser oscillator 85, rotational speeds of the developer roller 87 and the toner mixer 88 in each of the developer units 9A to 9D, the developing bias to the developer units 9A to 9D, the voltage to be applied to the electrifying charger 43, the transfer bias to the transfer drum 11 and the temperature of the heat roller 65, all of which are determined by the above-described humidity and temperature. The individual sections, such as the humidity detector 100, temperature detector 101, timer 121, coding circuit 122, memory controller 123 and memory 124, are always applied night and day with a drive voltage by the chargeable batter 120.

The voltage corresponding to the temperature detected by the temperature detector 101 may be coded and supplied via the memory 124 to the controller 80, so that the control concerning the humidity characteristic can be executed in accordance with the control output from the controller 80.

Further, although the foregoing description of the embodiments has been given with reference to a laser printer, the present invention is not limited to this particular type of application, but may be applied to a color copying machine, a facsimile and a monochromatic copying machine as well.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

an image forming means for forming an image on an image bearing member;

a humidity detecting unit detachably mounted to said image forming means for detecting the humidity in the vicinity of said image forming means and converting the detected humidity into a voltage value corresponding to the relative humidity;

means for adjusting the image forming conditions of said image forming means in accordance with a relative humidity detected by said humidity detecting means; and time detecting means for detecting the time for replacement of said humidity detecting means.

2. The image forming apparatus of claim 2, in which the time detecting means includes a battery connected to said humidity detecting means, the time for replacement of said humidity detecting means being determined from a voltage drop across the humidity detecting means.

3. The image forming apparatus of claim 1, in which the time detecting means includes a timer connected to the humidity detecting means to determine when the time for replacement of the humidity detecting means has been reached.

* * * * *